US008297940B2

(12) United States Patent
Williams

(10) Patent No.: US 8,297,940 B2
(45) Date of Patent: Oct. 30, 2012

(54) RELOCATABLE SUCKER ROD PUMP ASSEMBLY

(75) Inventor: Benny J. Williams, Godley, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 427 days.

(21) Appl. No.: 12/605,872

(22) Filed: Oct. 26, 2009

(65) Prior Publication Data

US 2011/0097217 A1 Apr. 28, 2011

(51) Int. Cl.
*F04B 19/00* (2006.01)

(52) U.S. Cl. ..... 417/238; 471/448; 471/555.2; 92/128; 166/68; 166/105

(58) Field of Classification Search ..... 417/555.2, 417/238, 448; 92/128, 216; 166/68, 68.5, 166/105

See application file for complete search history.

(56) References Cited

U.S. PATENT DOCUMENTS 2,266,344 A * 12/1941 Staerker ..... 403/316
3,040,812 A * 6/1962 Howard ..... 166/149
5,707,221 A 1/1998 Wittrisch
6,926,504 B2 * 8/2005 Howard ..... 417/417
7,390,173 B2 6/2008 Pasquan

OTHER PUBLICATIONS

Halliburton, Subsurface Flow Control Systems, Landing Nipples and Lock Mandrels, pp. 2-2 and 2-8.

* cited by examiner

*Primary Examiner* — Devon Kramer
*Assistant Examiner* — Joseph Herrmann
(74) *Attorney, Agent, or Firm* — Geoffrey A. Mantooth

(57) ABSTRACT

A downhole pumping assembly has a tubing string with plural barrels which are arranged in-line with the tubing. The tubing string has a seating location adjacent to each barrel. A standing valve arrangement, which includes a standing valve and a seating device, is located with the standing valve adjacent to the lower end of one of the barrels. A plunger has a traveling valve that is located for reciprocation within the one barrel. The plunger has a clearance with each of the barrels so as to form a fluid seal. The plunger reciprocates inside the barrel so as to lift fluid to the surface. Over time, the barrel will exhibit wear. Instead of pulling the entire tubing string to replace the barrel, the standing valve and the plunger are relocated to one of the other barrels located in the tubing string and reciprocation is resumed to resume pumping.

5 Claims, 4 Drawing Sheets

RELOCATABLE SUCKER ROD PUMP ASSEMBLY

FIELD OF THE INVENTION

The present invention relates to subsurface, or downhole pumps, such as are used to pump oil and other fluids and bases from wells.

BACKGROUND OF THE INVENTION

When an oil well is first drilled and completed, the fluids (such as crude oil) may be under natural pressure that is sufficient for the well to produce on its own. In other words, the oil rises to the surface without any assistance. In many oil wells, and particularly those in fields that are established and aging, natural pressure has declined to the point where the oil must be artificially lifted to the surface. Subsurface pumps are located in the well below the level of the oil. A string of sucker rods extends from the pump up to the surface to a pump jack device, beam pump unit or other devices. A prime mover, such as a gasoline or diesel engine, an electric motor or a gas engine, on the surface, causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one way valve, while the plunger has a traveling one way valve, or in some pumps the plunger has a standing one way valve, while the barrel has a traveling one way valve. Reciprocation charges a chamber between the valves with fluid and then lifts the fluid up the tubing towards the surface In many instances, the well is sandy. A sandy environment causes more wear on a pump and its components as the sand is abrasive. A worn pump does not operate particularly well if at all.

To fix the pump, it is pulled from the well, inspected, and the worn components replaced.

When a tubing pump is repaired, its various components are pulled from the well. For example, pulling the sucker rod string pulls the plunger to the surface. The plunger components can be replaced. Likewise, the standing valve can be pulled and replaced.

The barrel may be worn and require replacement. If the pump is an insert pump, then the barrel can be pulled from the well by the sucker rod string. However, if the pump is a tubing pump, the pump is in-line with, and forms a part of, the tubing. Consequently, the entire string of tubing must be pulled to access and replace the barrel. Pulling the entire tubing string is time consuming and costly. Yet, tubing pumps offer some advantages over insert pumps. For example, tubing pumps provide more fluid capacity that insert pumps.

It is desirable to minimize the cost of repairing and replacing tubing pumps which have barrel damage.

SUMMARY OF THE INVENTION

The present invention provides a downhole pumping assembly that comprises a tubing string with plural barrels. The barrels are arranged in-line with the tubing. Each of the barrels has an inside diameter. The tubing string has a seating location adjacent to each barrel. A standing valve arrangement comprises a standing valve and a seating device. The standing valve is located adjacent to a lower end of one of the barrels and coupled to the seating device. The seating device is coupled to the tubing string at the respective seating location. A plunger is provided with a traveling valve. The plunger is located for reciprocation within the one barrel. The plunger has a clearance with each of the barrels so as to form a fluid seal.

In accordance with one aspect of the present invention, the barrels are located adjacent to each other in the tubing string.

In accordance with still another aspect of the present invention, the barrels are coupled to the tubing string by barrel couplings, which barrel couplings form the seating locations.

In accordance with still another aspect of the present invention, the barrels are separated from each other in the tubing string by tubing.

In accordance with still another aspect of the present invention, the seating device is removably coupled to the tubing string.

In accordance with still another aspect of the present invention, the seating device comprises a lock mandrel.

In accordance with still another aspect of the present invention, the lock mandrel comprises a collar lock mandrel that is locked into a recess formed by a barrel coupling.

In accordance with still another aspect of the present invention, the lock mandrel removably engages a seating nipple in the tubing string.

The present invention also provides a method of operating a sucker rod pump assembly in a well that extends from a surface of the earth into the ground. Plural barrels are incorporated into a tubing string in the well. A plunger is located in the first one of the barrels. The plunger is reciprocated within the first one of the barrels and produces fluid from the well to the surface. The reciprocation of the plunger is suspended. The plunger is relocated to a second one of the barrels while maintaining the tubing string in the well. The plunger is reciprocated within the second one of the barrels and produces fluid from the well to the surface.

In accordance with one aspect of the present invention, the pump assembly comprises a standing valve. The standing valve is located in the first one of the barrels before the plunger is reciprocated within the first one of the barrels. The standing valve is relocated to the second one of the barrels before the step of reciprocating the plunger within the second one of the barrels.

The step of relocating the plunger to a second one of the barrels further comprises relocating the plunger to a second one of the barrels that is closer to the surface than the first one of the barrels.

In accordance with still another aspect of the present invention, the step of relocating the plunger to a second one of the barrels further comprises relocating the plunger to a second one of the barrels that is further from the surface than the first one of the barrels.

DESCRIPTION OF THE PREFERRED EMBODIMENT

The present invention provides a low cost way to repair tubing pumps which have barrel damage, which damage is typically due to sand and other abrasive agents. The tubing pump assembly of the present invention incorporated plural barrels and a single plunger. At any given time during pump operation, the plunger reciprocates inside one of the barrels. The other barrels are not used. Instead, the unused barrels simply stand by and await future use. As the plunger reciprocates over time, the barrel in use exhibits wear, particularly in a sandy environment. When the barrel is ready to be replaced, the plunger is relocated to another, unused, barrel in the well. Surprisingly, the barrels that are not in use do not exhibit wear during pump operation. In this manner, a worn barrel can be replaced with another barrel without the need to pull the tubing string from the well. This, replacing a worn barrel in a tubing pump can occur in a shorter time.

The plunger can be replaced by pulling the sucker rods and plunger; the tubing need not be pulled to replace the plunger.

Figure 1:
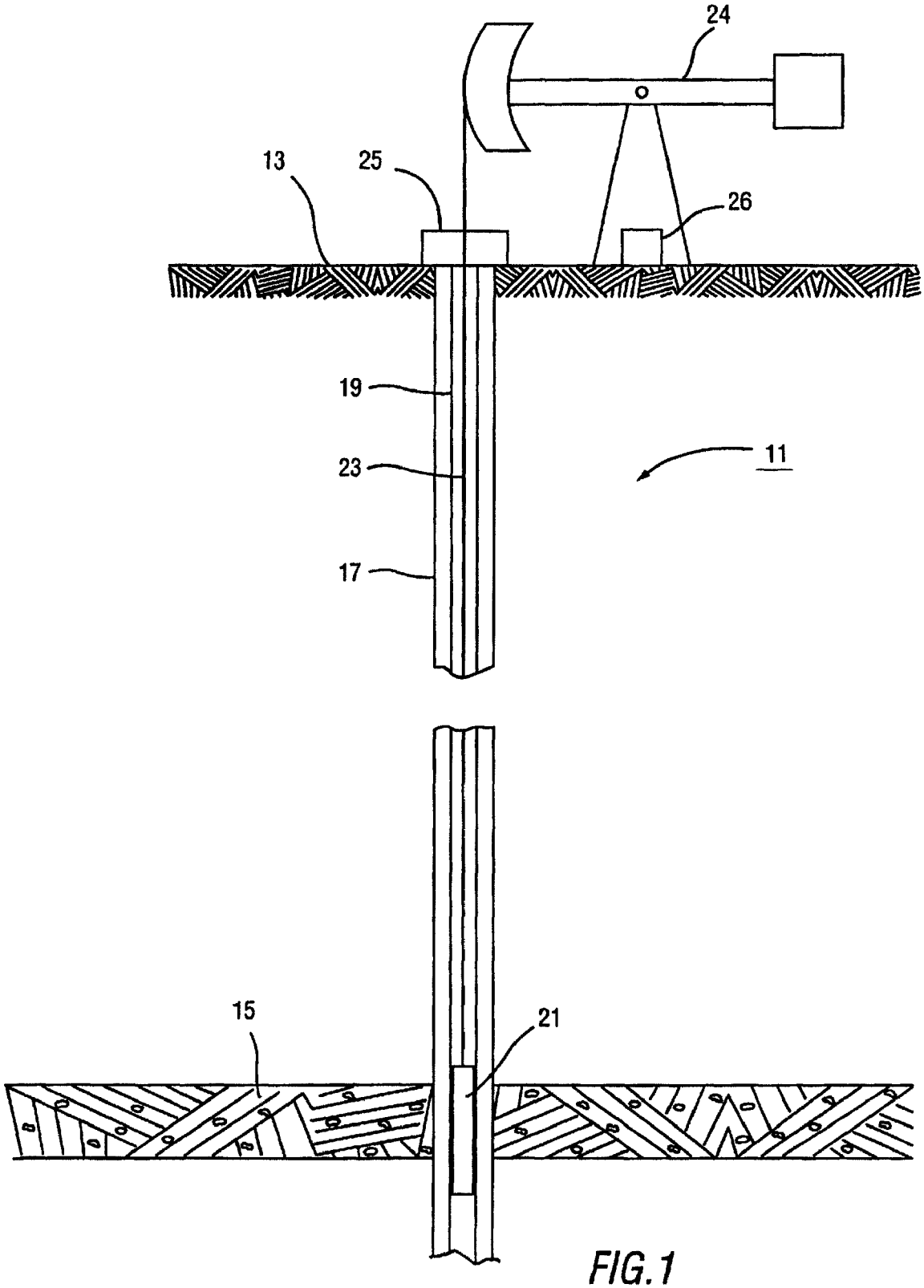
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation. A packer or other method (not shown) optionally isolates the formation 15 from the rest of the borehole. Tubing 19 extends inside of the casing from the formation 15 to the surface 13.

A subsurface pump 21 is located in the tubing 19 at or near the formation 15. A string of sucker rods 23 extends from the pump 21 up inside of the tubing 19 to a polished rod and a stuffing box 25 on the surface 13. The sucker rod string 23 is connected to a pump jack unit 24 which reciprocates up and down due to a prime mover 26, such as an electric motor, a gasoline or diesel engine, or a gas engine.

The pump 21 described herein is a tubing pump (as opposed to an insert pump). A tubing pump has its barrel incorporated into the string of tubing 19. An insert pump inserts a barrel into the tubing, which barrel is secure with a hold down and a seating nipple. The pump described herein has a fixed barrel and a reciprocating plunger.

Figure 2:
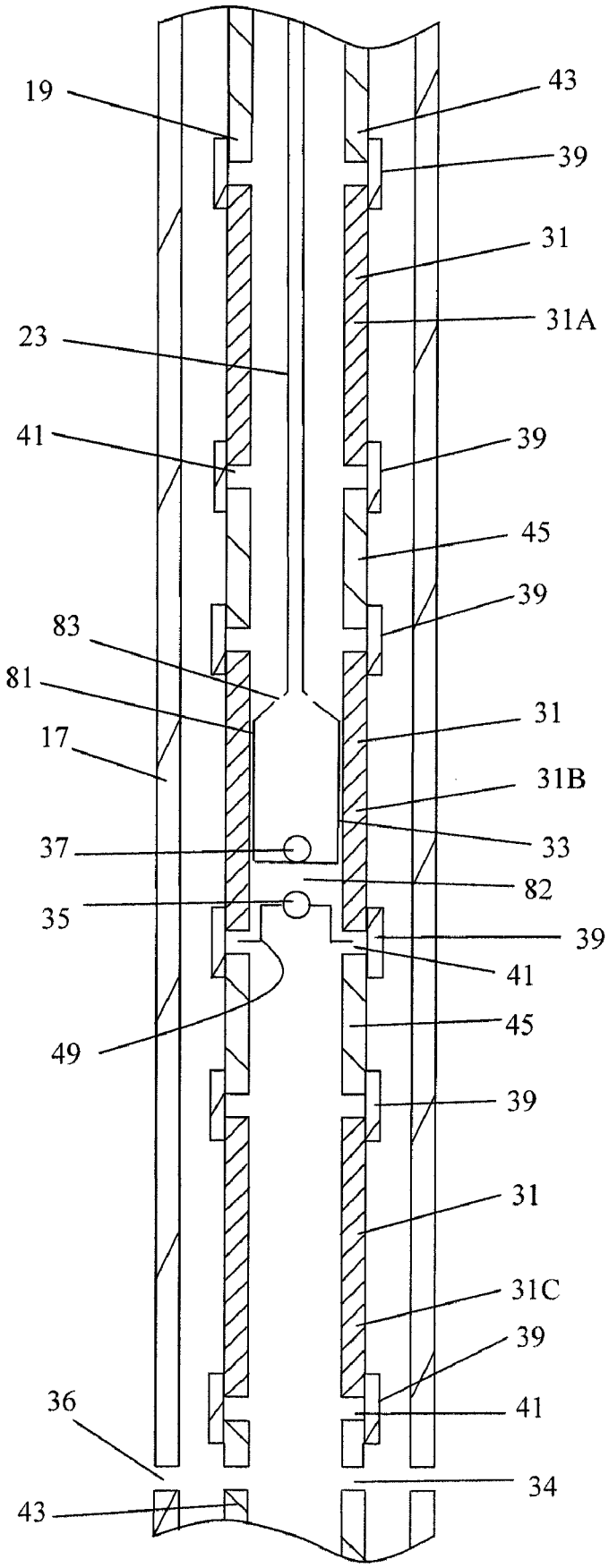
FIG. 2 is a schematic cross-sectional view of the pump assembly of the present invention, in accordance with a preferred embodiment, showing the pump in a first configuration.

The pump assembly 21 will now be described, with reference to FIG. 2. The pump assembly has plural barrels 31, a plunger 33 and associated valves. The valves typically include a standing valve 35 and a traveling valve 37. The plural barrels 31 are located in the tubing string 19. Only one of the barrels is used at any given time to pump oil and other fluids. In the embodiment shown, there are three barrels 31 contained in the tubing string, namely a top barrel 31A, an intermediate barrel 31B and a bottom barrel 31C (referring to the orientation of FIG. 2). The barrels 31 are joined into the tubing string 19 with tubing collars.

The tubing string 19 contains lengths of tubing 43, typically 30 feet long. Shorter lengths of tubing can be used, which are referred to as tubing subs 45. The tubing lengths 43 are joined together by tubing collars. A tubing collar has two sets of female threads, which threads engage and couple the male threads on the ends of the tubing 43. Almost all tubing threads are tapered.

A barrel, like a length of tubing, also has male threads on each end. These threads are typically non-tapered, or straight. As discussed below, barrel couplings 39 are used to couple the barrels into the tubing string 19. A recess 41 is formed in the interior of the tubing string by each barrel coupling 39.

A barrel 31 may come in various lengths, depending on the particular application, such as four feet to thirty feet long. The inside of a barrel has a smooth finish and a precise size, in order to accommodate the plunger and provide a seal with the plunger. The tolerance on the inside diameter of a barrel is typically 0.002 inches, while the tolerance on tubing is typically 0.032 inches. Furthermore, the tubing inside lacks the necessary concentricity and is eccentric. In fact, if a plunger is used in a piece of tubing, a fluid seal would not be formed between the plunger and the tubing. A barrel 31 is typically smaller in inside diameter than is tubing 43 of corresponding size.

The tubing string 19 thus has tubing extending from the surface down to the formation of interest. Attached to the tubing 43 is a first, or top, barrel 31A, then a tubing sub 45, a second or intermediate barrel 31B, another tubing sub 45, and a third, or lower, barrel 31C. Other types of tubing can be used in lieu of tubing subs to separate the barrels from one another in the tubing string. The barrels are attached to the tubing by way of barrel couplings 39. Recesses 41 are created between the ends of the barrels and tubing subs and between the ends of the barrels and the tubing.

The tubing string has perforations 34 therein. Thus, fluid can flow from the formation, through casing perforations 36 and through the tubing perforations 34 into the tubing string.

A standing valve 35 is provided for the barrels. The standing valve is located in a releasable seating assembly 49. There can be various types of releasable sealing assemblies. Illustrated herein are lock mandrels. Some lock mandrels 51 can engage the coupling recess 41 (see FIG. 3), while other lock mandrels 61 require a landing nipple 63 to be incorporated into the tubing string (see FIG. 4), which landing nipple provides the necessary recess 67.

Figure 3:
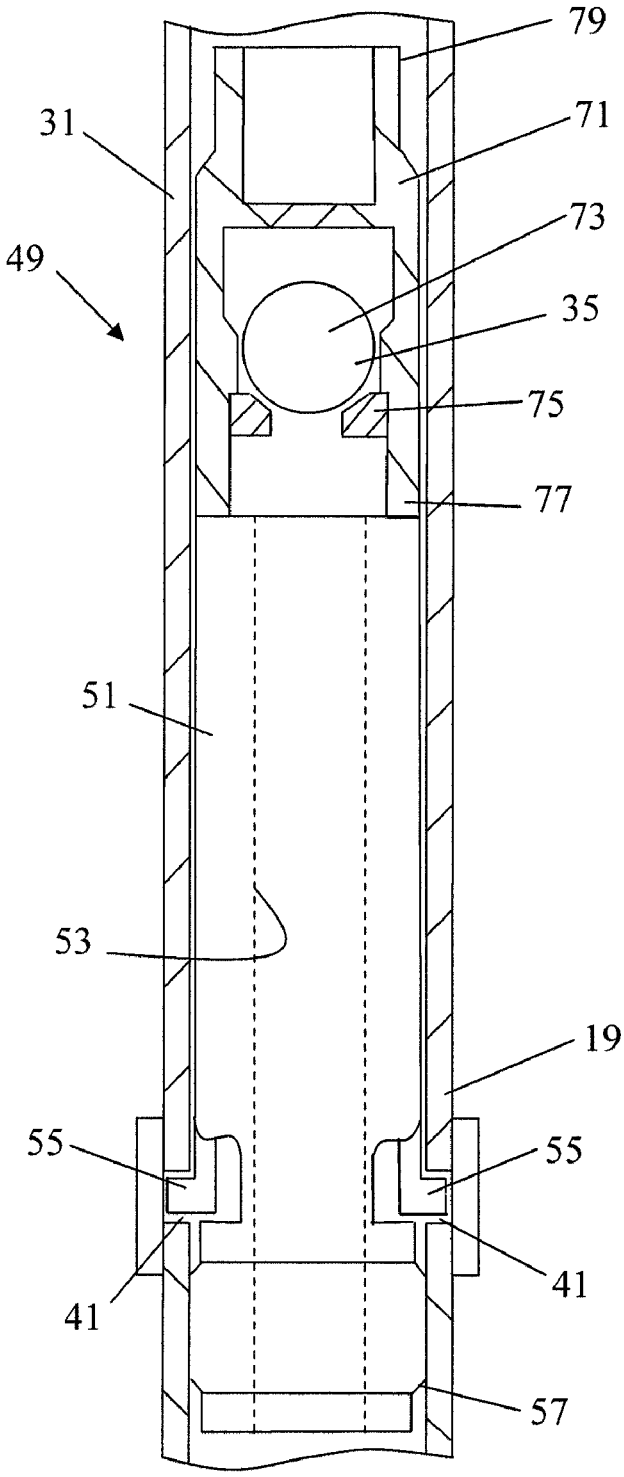
FIG. 3 is a cross-sectional view of the standing valve assembly and collar lock mandrel.

Referring to FIG. 3, the collar lock mandrel 51 is shown engaged. The collar lock mandrel is conventional and commercially available. The collar lock mandrel has an inside flow passage 53 (shown by dashed lines) that extends between the ends of the mandrel. The mandrel has dogs 55 (the mandrel is partially broken to show the dogs 55) that move between stowed and extended positions. In the stowed position, the dogs 55 are retracted, allowing the mandrel to be run into the tubing 43 and barrels 31. The mandrel 51 is located below the desired coupling recess 41. In order to set the mandrel, the mandrel is picked up, wherein the dogs 55 move to the extended position (as shown in FIG. 3) and engage the coupling recess 41. Once the dogs are engaged, the collar lock mandrel is locked in place. The collar lock mandrel also has a resilient element 57 on the outside, below or above the dogs. Upward jarring of the collar lock mandrel results in the outward expansion of the resilient element 57, which causes a seal to be made against the tubing string 19.

Figure 4:
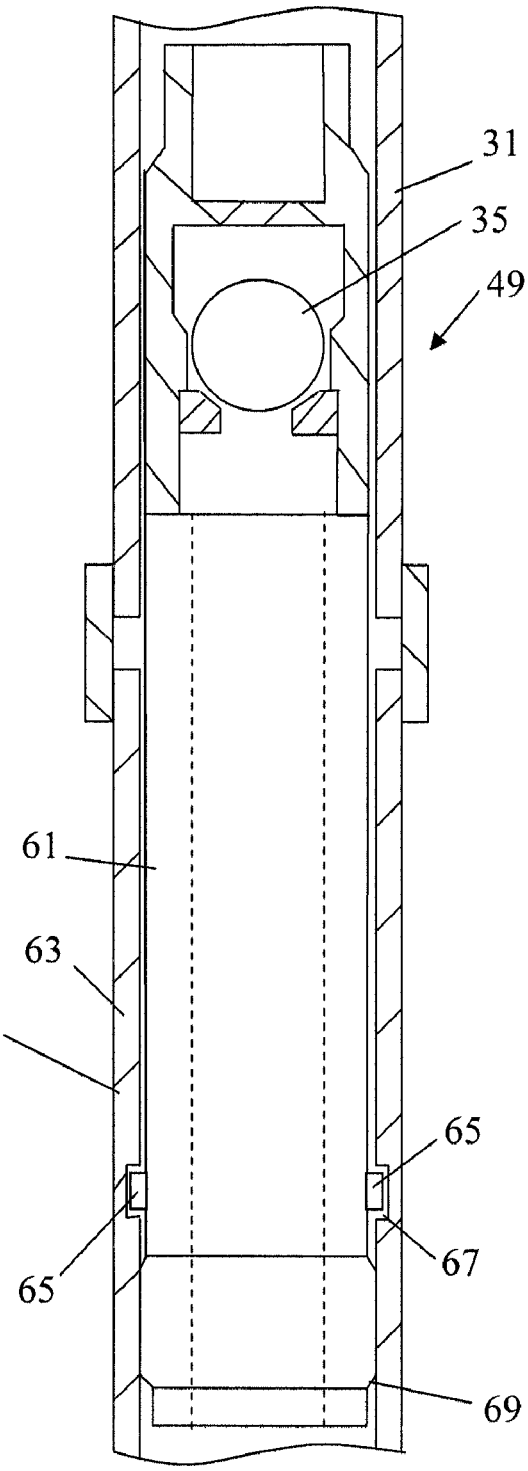
FIG. 4 is a cross-sectional view of the standing valve assembly and landing nipple.

Referring to FIG. 4, the lock mandrel 61 is shown, together with the landing nipple 63. The landing nipple 63, which receives and secures the lock mandrel 61, is part of the tubing string 19. Below each barrel 31 is a landing nipple. The landing nipple can be spaced below the respective barrel by way of a tubing sub, or the landing nipple can be located directly beneath, and coupled to, the respective barrel. The lock mandrel 61 has locking keys or dogs 65 that deployed to engage a groove 67 or a recess in the landing nipple 63. The lock mandrel also has resilient sealing elements 69 that provide a seal around the outside diameter of the mandrel. The lock mandrel 61 operates in a similar manner to the collar lock mandrel 51. The lock mandrel is lowered below the landing nipple 63, and then picked up to deploy the dogs 65. The dogs 65 catch in the recess or groove 67. After the dogs catch in the groove, further pulling up expands the resilient element 69.

The standing valve 35 is located on the top end of the collar lock mandrel (FIG. 3) or lock mandrel (FIG. 4). The standing valve 35 has a cage 71, a ball 73, a seat 75 and a seat coupler 77. The seat coupler 77 couples the standing valve to the respective mandrel. The outside of the cage 71 has a fishing neck 79.

The plunger 33 (see FIG. 2) is a tube having an outside diameter sized to the inside diameter of the barrel 31. Plungers and barrels are made with tight tolerances. In the preferred embodiment, a clearance 81 of 0.002-0.008 inches is provided between the plunger 33 and the barrel 31 so as to form a liquid or fluid seal. If the clearance 81 is too big, then a fluid seal is not fowled and the pump will experience leakage past the plunger. Barrels and plungers must be concentric to assure proper clearance. A non-concentric diameter will result in either a gap (lack of fluid seal) between the plunger and barrel or contact between the plunger and barrel, which produces high wear between the contacting components.

The plunger 33 has a traveling valve 37, which valve communicates with a compression chamber 82. The compression chamber is between the traveling and standing valves 37, 35. Typically, a traveling valve is located at the bottom of the plunger, although it may be located intermediate along the plunger or even at the upper end of the plunger. The length of the plunger is selected so as to operate with the barrel in the desired configuration, in accordance with conventional practice. The upper end of the plunger 31 has openings 83 to allow fluids to pass out of the plunger interior into the tubing 19. The sucker rod string 23 is coupled to the plunger either directly or by way of valve rods.

To install the pump assembly, the tubing string 19 is assembled piece by piece and lowered into the well. The tubing string 19 includes two or more barrels 31, with a recess 41 below each barrel for receiving the standing valve assembly. Although the tubing string can be equipped with a standing valve assembly as the surface, the more common practice is to lower the tubing string into the well and then lower the standing valve assembly.

A wireline can be used to lower the standing valve assembly. The standing valve assembly is lowered through the desired barrel. For example, as shown in FIG. 2, the intermediate barrel 31B is to be used in pumping operations. The standing valve assembly is thus lowered through the upper barrel 31A and through the intermediate barrel 31B. The standing valve assembly is positioned just below the appropriate recess. The standing valve assembly is then picked up to locate and lock the mandrel 51, 61 in the recess 41, 67. Once the mandrel is locked, additional upward jarring is applied to expand the resilient element 57, 69 and make the seal. The standing valve assembly is now in position, with the standing valve 35 preferably located within the lower end of the barrel 31.

The plunger 33 is lowered into the tubing by the sucker rod string 23. The plunger is positioned within the intermediate barrel 31B. The pump is now ready to operate.

During pump operations, the sucker rod string reciprocates the plunger inside of the intermediate barrel 31B. The pump operates normally, lifting fluid to the surface through the tubing 19.

The pump plunger 33 and barrel 31 will experience wear, particularly in a sandy well. To replace the plunger 31, the sucker rod string 23 and plunger are pulled from the well. The sucker rod string is then run back into the well with the replacement plunger and associated components.

Figures 5, 6:
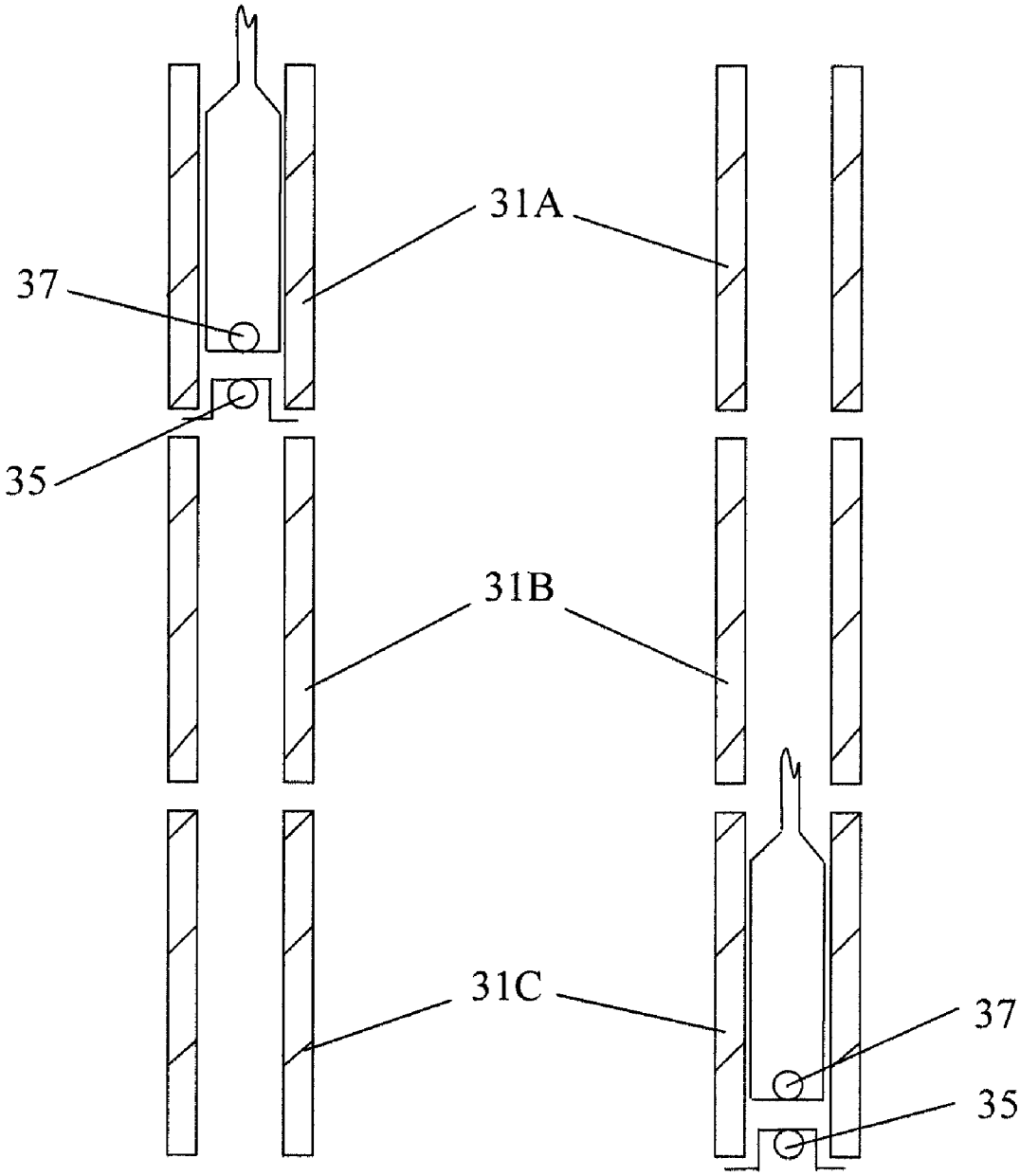
FIG. 5 is a schematic cross-sectional view of the pump assembly of FIG. 2, shown in a second configuration.
FIG. 6 is a schematic cross-sectional view of the pump assembly of FIG. 2, shown in a third configuration.

If the barrel 31B needs to be changed, then the sucker rod string and plunger are pulled from the well. A wireline, slick line, etc. is run into the well with a fishing tool, which fishing tool couples to the standing valve assembly 49. The mandrel is freed from the tubing (for example by pushing down on the mandrel with a weight or using a jarring action). Once freed, the standing valve assembly can be retrieved to the surface so as to inspect, and if necessary, replace the standing valve parts. After inspection and/or replacement, the standing valve assembly is lowered to a position just below the next barrel. In the alternative, the standing valve assembly is not retrieved to the surface; it is moved to the next barrel and set as described above. The next barrel could be above (see FIG. 5) or below (see FIG. 6) the worn barrel 31B.

Once the standing valve assembly is repositioned, a plunger is run into the well, positioned in the barrel and pumping operations can resume.

Thus, the present invention allows a tubing pump barrel to be changed while minimizing the need for pulling the tubing string. In most instances of barrel replacements, the tubing string stays intact and inside the well while the pump components are relocated to an unused barrel. After all of the barrels become worn, the tubing string is pulled and the barrels are replaced. The tubing string, with new barrels, is then lowered back into the well. The plunger is located inside of a selected one of the barrels, wherein pumping operations can resume once more.

The tubing string can be equipped with two or more barrels. The spacing between the barrels is determined by various factors such as the length of the barrels and the length of the standing valve assemblies.

The foregoing disclosure and showings made in the drawings are merely illustrative of the principles of this invention and are not to be interpreted in a limiting sense.

The invention claimed is:

1. A method of operating a sucker rod pump assembly in a well that extends from a surface of the earth into the ground, comprising the steps of:

a) providing at least a first barrel and a second barrel incorporated into a tubing string in the well with the first barrel closer to the surface than the second barrel, and a plunger reciprocated by a sucker rod string from the surface of the well;

b) locating the plunger in one of the first or the second barrel;

c) reciprocating the plunger within the one of the first or the second barrel and producing fluid from the well to the surface;

d) suspending the reciprocation of the plunger;

e) relocating the plunger to the other of the first or the second barrel while maintaining the tubing string in the well;

f) reciprocating the plunger within the other of the first or the second barrel and producing the fluid from the well to the surface, wherein when the plunger is in the second barrel the sucker rod string reciprocates through the first barrel.

2. The method of claim 1, wherein the pump assembly comprises a standing valve, comprising the steps of:

a) locating the standing valve in the one of the first or the second barrel before the step of reciprocating the plunger within the one of the first or second barrel;

b) relocating the standing valve to the other of the first or the second barrel before the step of reciprocating the plunger within the other of the first or the second barrel.

3. The method of claim 1, wherein the step of relocating the plunger to the other of the first or the second barrel further comprises the step of relocating the plunger from the second barrel to the first barrel.

4. The method of claim 1, wherein the step of relocating the plunger to the other of the first or the second barrel further comprises the step of relocating the plunger from the first barrel to the second barrel.

5. A method of installing a sucker rod pump assembly into a well that extends from a surface of the earth into the ground, comprising the steps of:

a) assembling a tubing string, the tubing string having a first barrel and a second barrel, and inserting the tubing string into the well so that the first barrel is closer to the surface than is the second barrel and providing a recess in an interior of the tubing string adjacent to each of the first and second barrels;

b) inserting a standing valve into a selected one of the first or second barrels and installing the standing valve into the respective recess;

c) inserting the plunger with the traveling valve into the selected first or second barrel, wherein reciprocation of the plunger driven by a sucker rod from the surface within the selected first or second barrel produces fluid to the surface and when the standing valve is located in the recess of the second barrel the sucker rod reciprocates through the first barrel.

* * * * *